US008483902B2

(12) United States Patent
Cornet et al.

(10) Patent No.: US 8,483,902 B2
(45) Date of Patent: Jul. 9, 2013

(54) METHOD FOR CONTROLLING THE CONSUMPTION AND FOR DETECTING LEAKS IN THE LUBRICATION SYSTEM OF A TURBINE ENGINE

(75) Inventors: Albert Cornet, Verviers (BE); Nicolas Raimarckers, Tourinne (BE); Denis Bajusz, Schaerbeek (BE)

(73) Assignee: Techspace Aero S.A., Milmort (BE)

( * ) Notice: Subject to any disclaimer, the term of this patent is extended or adjusted under 35 U.S.C. 154(b) by 760 days.

(21) Appl. No.: 12/334,981

(22) Filed: Dec. 15, 2008

(65) Prior Publication Data

US 2009/0164056 A1 Jun. 25, 2009

(30) Foreign Application Priority Data

Dec. 21, 2007 (EP) ..... 07447071

(51) Int. Cl.
*G01M 15/00* (2006.01)

(52) U.S. Cl.
USPC ..... 701/29.5; 701/3; 701/100; 184/6.11; 73/114.56

(58) Field of Classification Search
USPC ..... 701/3, 123, 29.1, 29.5, 99–102; 184/6.11, 184/7.4, 108–109; 123/73 AD; 73/19.11, 73/114.55, 114.56
See application file for complete search history.

(56) References Cited

U.S. PATENT DOCUMENTS

| | | | | |
|---|---|---|---|---|
| 5,245,869 | A * | 9/1993 | Clarke et al. | 73/149 |
| 6,213,080 | B1 * | 4/2001 | Marsh et al. | 123/196 R |
| 6,924,214 | B2 * | 8/2005 | Jakoby | 438/496 |
| 2004/0079150 | A1 * | 4/2004 | Breed et al. | 73/291 |
| 2004/0093150 | A1 * | 5/2004 | Arai et al. | 701/104 |
| 2008/0103703 | A1 * | 5/2008 | Tichborne et al. | 702/51 |
| 2009/0076677 | A1 * | 3/2009 | Walthall et al. | 701/30 |
| 2009/0107771 | A1 * | 4/2009 | Liu et al. | 184/7.4 |

FOREIGN PATENT DOCUMENTS

| | | | |
|---|---|---|---|
| DE | 4118896 | A1 | 12/1992 |
| DE | 10061041 | A1 | 6/2002 |
| EP | 0 513 957 | A1 | 11/1992 |
| JP | 57072011 | A | 5/1982 |
| WO | WO 94/20739 | A2 | 9/1994 |

* cited by examiner

*Primary Examiner* — Thomas Black
*Assistant Examiner* — Ce Li
(74) *Attorney, Agent, or Firm* — Reinhart Boerner Van Deuren P.C.

(57) ABSTRACT

The present invention relates to a method for calculating the oil consumption and autonomy associated with the lubrication system of an airplane engine during flights, preferably a turbine engine, on the basis of the measurement of the oil level in the tank of said lubrication system, allowing to manage the refills and maintenance and to detect either abnormal consumption or insufficient autonomy, characterized by at least one of the following methods:

comparing different engines of the airplane and possibly a reference value, the engines used for said comparison being in more or less identical condition, in order to detect abnormal oil consumption;

taking into account one or more interference effects that affect said oil level in the tank, these being linked at least to the thermal expansion in the tank, to the "gulping" and to the attitude and acceleration, in order to deduce the modification to the oil level due to a decrease in the total quantity of oil available as a result of said interference effects;

combining both above-mentioned methods.

17 Claims, 2 Drawing Sheets

METHOD FOR CONTROLLING THE CONSUMPTION AND FOR DETECTING LEAKS IN THE LUBRICATION SYSTEM OF A TURBINE ENGINE

CROSS-REFERENCE TO RELATED PATENT APPLICATIONS

This patent application claims the benefit of European Application No. 07447071.7, filed Dec. 21, 2007, the entire teachings and disclosure of which are incorporated herein by reference thereto.

FIELD OF THE INVENTION

The present invention relates to the general area of the lubrication of an aircraft turbine engine.

More specifically, it relates to the monitoring of leaks and of the consumption of a jet engine lubrication system by measuring the level in the oil tanks and the consumption.

STATE OF THE ART

An aircraft turbine engine comprises many elements that need to be lubricated: these are in particular roller bearings used to support the rotation shafts, as well as the gears of the accessory drive case.

To reduce friction, wear and overheating due to the high rotation speeds of the turbine engine shafts, the roller bearings that support them therefore need to be lubricated. Since a simple lubrication by spraying oil only during the maintenance sessions on the turbine engine is not sufficient, it is generally necessary to rely on a so-called "dynamic lubrication".

Dynamic lubrication consists in putting oil into continuous circulation in a lubrication circuit. A flow of lubrication oil coming from a tank is thus passed over the roller bearings by a pump.

One example of such a system for lubricating a turbine engine is described in particular in document EP-A-513 957.

On the ground, during planned maintenance, some airline companies keep track of the number of lubricant cans used to fill up the oil tanks. This allows to determine the average consumption during the flights since the last refill and, on the basis of the cumulative flight distances, to possibly identify any abnormal leakage rate. However, identifying an abnormal leak during planned maintenance is only possible if it is small enough not to cause an anomaly in the engine before the planned maintenance.

Using a level sensor in oil tanks would allow a more accurate, reliable, easier and repetitive identification of consumption, as well as the detection of any possible leak or abnormal consumption without waiting for maintenance sessions. Moreover, predicted range levels would also allow to introduce predictive rather than planned maintenance, as well as refill management.

A level sensor for the oil tank exists in modern jet engines. Nevertheless, detecting a problem during flights is currently based on a simple minimum threshold being exceeded.

Identifying a major leak based on the current level and therefore predicting low residual range would occur before the minimum threshold is reached and would thus leave more time between the detection of the failure and the implementation of the adequate response.

In document US 2004/0093150 A1, there is provided an engine oil degradation-determining system which is capable of accurately detecting whether or not engine oil has been replenished, to thereby enhance accuracy of determination as to a degradation level of engine oil in use, at a low cost. A crankshaft angle sensor detects the engine rotational speed of an internal combustion engine. An ECU calculates a cumulative revolution number indicative of a degradation level of engine oil. An oil level sensor detects an oil level of the engine oil. When the detected oil level, which was equal to or lower than a predetermined lower limit level before stoppage of the engine, is equal to or higher than a predetermined higher limit level after start operation following the stoppage, the calculated cumulative revolution number is corrected in the direction of indicating a lower degradation level.

AIMS OF THE INVENTION

The present invention aims to provide a solution that allows to overcome the drawbacks of the state of the art.

In particular, the invention aims to provide the continuous monitoring of a turbine engine lubrication system that would allow to reduce the costs associated with oil leaks that constitute a major cause of incidents (such as ATO for Aborted Take-Off, IFSD for In-Flight Shut-Down, D&C for Delay & Cancellation) on the one hand and associated with planned maintenance on the other.

Moreover, the invention aims, in addition to preventing incidents during flights, to allow, by evaluating the residual oil range, to replace planned maintenance by predictive maintenance and thereby to avoid pointless maintenance, as well as to manage oil refills.

SUMMARY OF THE INVENTION

A first object of the present invention, mentioned in Claim 1, relates to a method for calculating the oil consumption and range associated with the lubrication system of an airplane engine during flights, preferably a turbine engine, based on the measurement of the oil level in the tank of said lubrication system, which would allow to manage refills and maintenance, and to detect either abnormal consumption or insufficient range, characterised by at least one of the following methods:

- comparing different engines of the airplane, and possibly with a reference value, the engines used for said comparison being in more or less identical condition, in order to detect abnormal oil consumption;
- taking into account one or more interference effects that affect said oil level in the tank, these being linked to the thermal expansion in the tank, to "gulping" and/or to the attitude and acceleration, in order to deduce the modification of the oil level due to a modification of the total quantity of oil available in the tank resulting from said interference effects;
- combining both above-mentioned methods.

A second object of the present invention, mentioned in Claim 16, relates to an IT system for implementing the process for calculating the oil consumption and range associated with the lubrication system of an airplane engine during flights, preferably a turbine engine, such as described above, characterised in that it comprises:

- a memory (1) with a main program for implementing said process, as well as data related to the flight in progress and to the next flights and data related to at least a second engine of the airplane;
- a first programmable data processor (2), called a "short-term" processor, operated under the control of said main program for estimating the interference effects on the oil consumption, for estimating the total quantity of oil available and the current and average consumptions by the engine, for detecting consumption anomalies compared with one or several thresholds and for calculating the range for the flight in progress and for the next flights;

- a second programmable data processor (3), called a "middle-term" processor, operated under the control of said main program, for calculating the current and average consumptions of the engine, based on the total quantity of oil available for each phase of the flight;
- a third programmable data processor (4), called a "long-term" processor operated under the control of said main program, for evolvingly re-evaluating the "gulping"-estimation parameters depending on the data acquired during previous flights, for calculating the average consumption taking into account previous flights and which can be used to calculate the range of the next flights and for re-evaluating the thresholds of normal consumption;
- a means for displaying alarms and visual and/or sound indications (5).

A third subject of the present invention relates to a computer program with a code suitable for implementing the process for calculating the oil consumption and range associated with the lubrication system of an airplane engine during flights, such as described above, when said program is executed on a computer.

Preferred embodiments of the invention are mentioned in the dependent claims, the characteristics of which may be considered individually or in combination according to the invention.

SHORT DESCRIPTION OF THE DRAWINGS

DETAILED DESCRIPTION OF THE INVENTION

According to the invention, the above-mentioned detection is allowed by the implementation of a algorithm for calculating the current oil consumption. Unfortunately, the only level given by the detector does not allow to directly determine the consumption since the level in the tank is also affected by interference mechanisms and effects. The algorithm implemented to evaluate consumption and detect anomalies must eliminate or overcome this problem.

A first strategy consists in comparing (the) different engines of the same airplane. In this case, the interference effects are not eliminated but they may be considered as identical for both engines. Abnormal consumption is detected by the difference between the values for both engines and/or with a reference value (theoretical or evaluated during the running-in of the engine).

Another strategy consists in taking into account, totally or partially, the various interference mechanisms and effects in order to evaluate the consumption from the oil level measurement taken and to determine whether it is normal.

Both types of strategy may also be combined.

Figure 1:
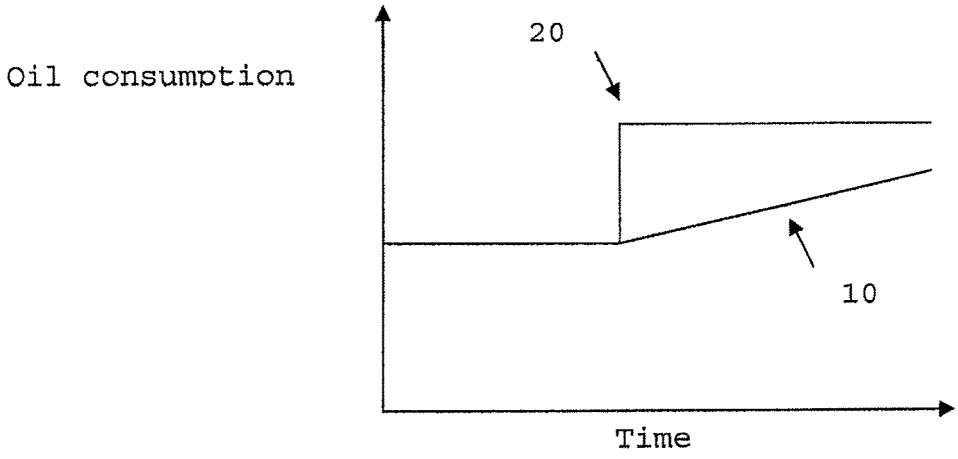
FIG. 1 is a diagram of the variation in oil consumption of a jet engine over time under the effects of aging 10 or of sudden damage 20.

The above-mentioned interference mechanisms are the following:

- thermal expansion in the oil tank: the law of thermal expansion with regard to oil and the shape of the tank being known with good accuracy, knowing the temperature in or near the tank is sufficient to deduce the contribution of this phenomenon to the oil level measured in the tank;
- attitude and acceleration: depending on the shape of the tank and on the position of the level sensor, the effect of the acceleration and of the inclination of the airplane may be taken into account. It will be noted that, in civil aviation, where inclination does not exceed 20°, these effects could be ignored provided that the sensor is located close to the symmetry plane of the tank;
- gulping or oil retention in the chambers: this effect is the major cause of variation in oil level in the tank. It depends on the rotation speed of the drive shafts and on the oil temperature, which itself depends on the rotation speed (among other effects such as external temperature, other thermal loads inherent to the operating mode, etc.). The dynamics associated with the thermal inertia of the engine make the identification of this contribution problematic during transitory periods; by concentrating on stabilised operating modes where the rotation speed is constant, part of the inherent complexity is dispensed with. It is noted that the oil thermal expansion in the channels and bearing chambers may be considered as belonging to this effect;
- aging effect: this is not per se an interference effect but a change with age in the oil consumption of the engine. It is important to be able to distinguish a normal progressive increase 10 over time due to aging from a sharp increase due to a failure 20 (see FIG. 1). The change in average consumption with age may be pre-recorded (according to the results of experience with other engines) or obtained evolvingly by successive comparisons between various flights of the engine being monitored. A simpler solution consists in determining a fixed consumption threshold that is not to be exceeded, but the leak detection is then less sensitive.

Depending on the degree of knowledge about these mechanisms and on the accuracy of the level measurement, the consumption measurement and the leak detection will be more or less sensitive and the setup period required to obtain this sensitivity will be longer or shorter. More particularly, the prediction level of the contribution from gulping will determine different levels of algorithmic architectures, to which various possibilities for exploiting the results correspond (see Table 1).

The absence of knowledge about the interference effects is compensated for by working "by delta" (by the difference between a final value and an initial value) compared to a tank level taken as a reference.

Stage 1 corresponds to the measurement of the level at the start and at the end of the flight in order to evaluate the quantity consumed. In Stage 2, this approach is improved by delta over the entire flight by introducing a correction to the tank level at the end of the flight thanks to the knowledge of the gulping at the end depending on the temperature.

Stages 2 and 3 introduce level measurements during the flight phases (at the start and at the end of each phase or continuously). When knowing the effect of the temperature in a constant operating mode, it is possible to work by delta during a same phase (relative to the level at the start of the phase).

Stages 4 and 5 correspond to a constant monitoring of the oil level, that is possible if all the interference effects can be estimated during phases and in transitories.

TABLE 1

| Knowledge of gulping and level measurements | Measurement and detection on the ground | Measurement and detection during flight |
|---|---|---|
| Stage 1 (state of the art): | | |
| No estimation of gulping<br>Oil level measured at the start and at the end of the flight | What remains of the gulping after the flight (delay due to thermal inertia) is considered as lost<br>A major leak can be detected over a long period at the end of the flight<br>Autonomy is calculated in "standard flights" | Ø |
| Stage 2: | | |
| Average gulping known depending on the oil temperature, engine stopped<br>Oil level measured at the start and at the end of the flight | Same as Stage 1 but the remaining gulping is evaluated and the results are less conservative<br>The accuracy of consumption measurement and leak detection is refined<br>More realistic autonomy calculation | Ø |
| Stage 3: | | |
| Average gulping known depending on the oil temperature for each engine operating mode, at constant rotation speed (≠0)<br>Oil level measured at the start and at the end of each phase | Consumption is calculated by phase<br>Leaks reduced and detectable at shorter intervals (by phase)<br>Range calculation specific to future flights (depending on their phases) | Ø |
| Stage 4: | | |
| Same knowledge of gulping as in Stage 3<br>Oil level measured several times for each phase | Detection on the ground remains similar to the previous case but more accurate | Leak detectable during a phase<br>In the event of a leak, indication of estimated autonomy in hours<br>The system must be deactivated during transitories |
| Stage 5: | | |
| Gulping known depending on the oil temperature and on the rotation speed<br>Level measured several times for each phase and during transitories | Same as Stage 4 | Gulping is also evaluated during transitories and the same applies to consumption<br>Leak detection is possible in transitories<br>Autonomy calculation is even more accurate |

DESCRIPTION OF A PREFERRED EMBODIMENT OF THE INVENTION

Figure 2:
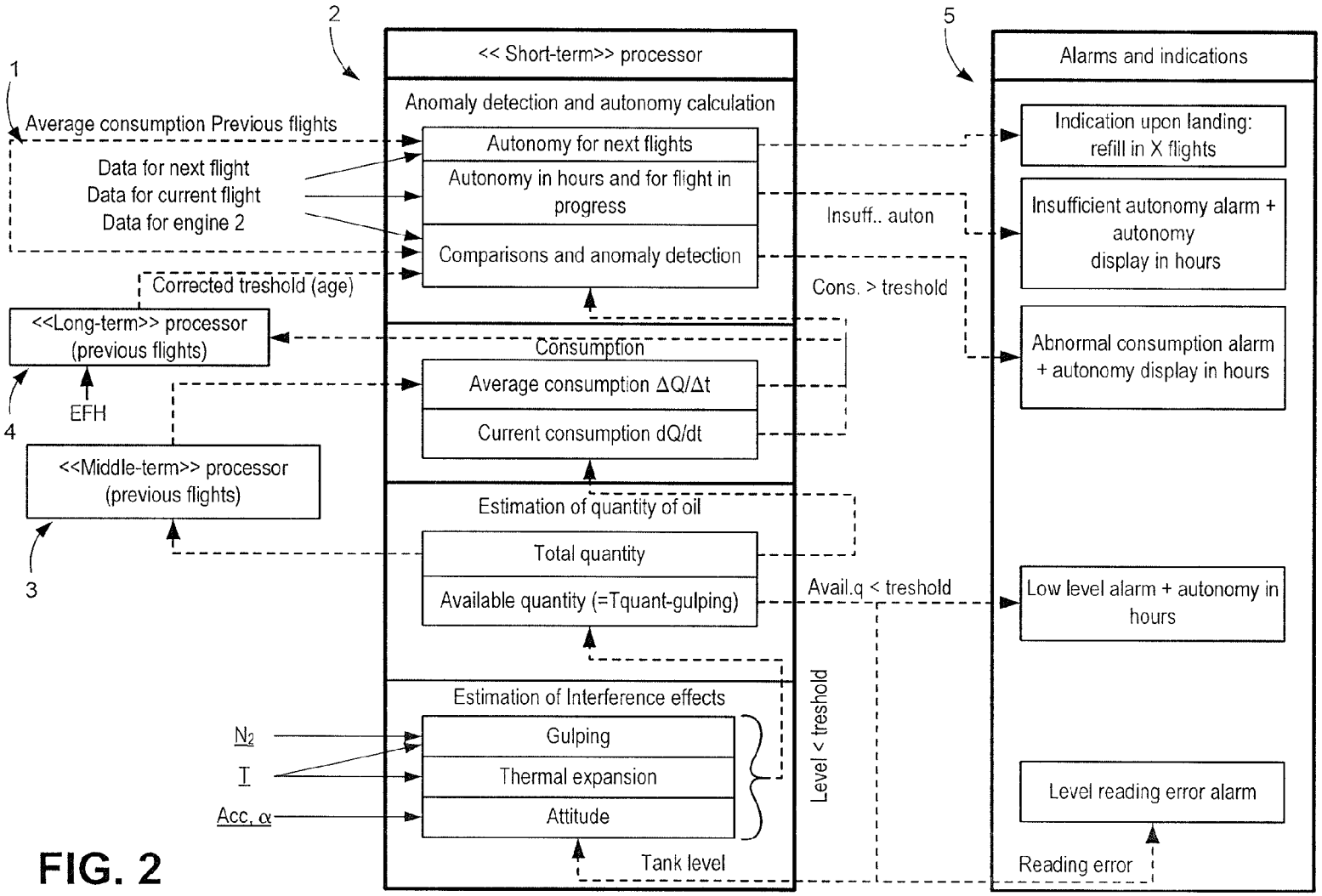
FIG. 2 is a diagram of a preferred example of the program architecture allowing to calculate the quantity of oil available in the engine, to calculate the consumption and range and to detect abnormal consumption or insufficient range as in the present invention (EFH=Engine Flight Hours).

The program architecture represented in FIG. 2 corresponds to the level or Stage 4 in the above Table 1, combined with a comparison between the information from both engines in order to aid detecting abnormal consumption by one of them.

In this example of architecture, the level of the tank is processed at the same time as the other information in order to extract the total quantity of oil remaining in the entire engine and the quantity available in the tank (total quantity less the quantity held in the chambers by gulping). This is a tank level where, once the thermal expansion, the attitude and the inclination have been taken into account, an available quantity generates an estimate of range expressed in hours, based on a typical consumption, calculated at a higher level in the architecture.

The total quantity is then used to calculate the current consumption and the average consumption of the phase in progress (or of a rolling period of the phase, the length of which is fixed by the required accuracy).

The current consumption is transmitted only to the module for comparing and estimating range whereas the average consumption is also recorded and processed in the "long-term" processor, where the normal consumption thresholds are re-evaluated in the light of this information, of the total flight time of the engine, of the number of maintenance sessions, etc. The "long-term" processor may have other functions such as re-evaluating the parameters used for estimating the gulping depending on the results of experience with the engine (by evolving algorithms), or calculating the average consumptions taking into account previous flights, which can be used to calculate the range relative to the next flights.

Current and average consumptions are compared with those of the other engine (engine no. 2) and with their respective thresholds (re-evaluated by the "long-term" processor) and any anomaly is signalled by an alarm. Average consumption is also used to estimate whether autonomy is sufficient to complete the flight in progress. If not, an alarm is generated and, depending on the profiles of the next flights, the number of remaining flights before the tank has to be refilled is recalculated.

The total quantity of oil must of course be reinitialised at the start of each flight, knowing that before the engine is started, all the oil is in the tank, in order to avoid false alarms if the tank has been refilled.

The time required for detecting abnormal consumption will depend on:

- the flow rate of any leak, which may be negative in the event of a leak of kerosene into the oil;
- the accuracy with which the level is measured in the tank;
- the quality of estimates (thermal expansion, gulping, attitude, aging).

Once the flow rate of the leak is identified, it can be used to determine its origin, once studies and sufficient results from experience have allowed to attribute "signatures" to certain failures in terms of the leak flow rate.

Compared with the current use of the tank level during flights (simple minimum level), the innovation consists in allowing the detection of sufficiently large leaks well before what occurs in the state of the art and therefore allowing to modify the course of the airplane or to stop the engine before the failure occurs. The invention prevents many broken bearings due to the absence of oil and lastly, it allows better maintenance planning by the airline company, for example, if a significant increase in consumption, attributable to the aging of a piece of equipment, is noticed, that may be identified by its signature.

Compared with the estimates previously made on the basis of refills on the ground, i.e. calculating the consumption by the difference between two levels separated by several flights, the innovation consists in using an average consumption re-evaluated depending on the age of the engine and on previous flights. Moreover, it is possible to calculate the autonomy for future flights, which allows to schedule future refills.

The invention thus allows to generalise the measurement taken, to eliminate the risks of human error, but above all to achieve a sensitivity to much smaller leaks, that allows maintenance scheduling and immediate response during flights, even allowing to change the course of the aircraft if the leak is definitely too big.

The advantages of the present invention are therefore:

- rapid detection of leaks, reducing the risk of incidents during flights and allowing to modify the flight plan if necessary;
- a system that avoids pointless planned maintenance and can help identify obsolete or out-of-order equipment, which also reduces maintenance costs.

The invention claimed is:

1. Method for calculating oil consumption and range associated with a lubrication system of an airplane engine during flights, the airplane including a plurality of engines, based on a measurement of an oil level in a tank of said lubrication system, allowing management of refills and maintenance and detection of either abnormal consumption or insufficiency range, characterised by a combination of the following methods:

- comparing with a processor different engines of the airplane and possibly a reference value, the engines used for said comparison being in more or less identical condition, in order to detect abnormal oil consumption;
- taking into account with a processor one or more interference effects that affect said oil level in the tank, these being linked at least to the thermal expansion in the tank, to gulping and to attitude and acceleration, in order to deduce a modification to the oil level due to a decrease in total quantity of oil available as a result of said interference effects; and wherein, for a measurement and detection when the airplane is landed or during flights:
- oil levels are measured several times during each phase and during the transitories;
- an average gulping is estimated depending on an oil temperature and on rotation speed, including in flight during transitories;
  - a range value is deduced from there and is specific to future flights; and characterised by the following substages:
- a current oil level is measured in the oil tank of one of the engines;
- said interference effects are estimated, including gulping;
- a value of the quantity of oil available is calculated by subtracting from the a priori known total quantity of oil a difference in oil quantity associated with a quantity retained outside the tank as a result of these interference effects, linked in particular to gulping;
- if the value of the available quantity is lower than a predetermined threshold value, a low oil level alarm is emitted and a range value in hours is communicated;
- based on the total quantity of oil, a current and an average oil consumption of the engine are calculated over the flight phase in progress or over a rolling period during the flight phase in progress, a length of which is fixed by a required accuracy;
- the current consumption value is used in a comparison and range estimation unit whereas the average consumption value is recorded and processed a processing unit called a long term processor in which thresholds of normal consumption resulting from measurements and calculations from previous flights are re-evaluated in particular in view of this average consumption value, of a total flight time of the engine and of a number of maintenance sessions performed.

2. Method as in claim 1, wherein gaps in a characterisation of said interference effects are compensated for by working by delta, i.e. by a difference between two levels, compared with a specified tank level taken as reference level.

3. Method as in claim 1, wherein, for a measurement and detection on the ground:

- the oil level is measured at the start and at the end of a flight;
- the average gulping is estimated depending on an oil temperature, the engine being stopped;
- the range value is derived from there.

4. Method as in claim 1, wherein, for a measurement and detection on the ground:

- the oil level is measured at the start and at the end of each phase of a flight;
- the average gulping is estimated depending on an oil temperature, for each operating mode of the engine, at a constant rotation speed;
- the range value is derived from there and is specific to future flights, depending on their phases.

5. Method as in claim 1, wherein, during flights, if a leak is detected during a phase, an estimated range is indicated, no action being taken during transitories.

6. Method as in claim 1, wherein, if the current oil level in the tank is lower than the predetermined threshold value, an oil level reading fault alarm is emitted.

7. Method as in claim 1, wherein the interference effects associated with thermal expansion in the tank, gulping and attitude respectively are estimated based on at least one of the shape of the tank and an oil temperature, the shape of the tank and the position of a level sensor in the tank, and an oil temperature and the rotation speed of drive shafts of the engine.

8. Method as in claim 1, wherein parameters for estimating the gulping are evolvingly re-evaluated in the "long-term" processor, depending on results of experience with the engine.

9. Method as in claim 1, wherein the average consumptions are calculated in the long-term processor, taking into account previous flights, the average consumptions can be used to calculate a range of future flights with the generation, upon landing, of an indication of an estimated future refill.

10. Method as in claim 9, wherein the current and average consumptions are compared with those of the other engine and with their respective thresholds, which are re-evaluated by the long-term processor.

11. Method as in claim 10, wherein an anomaly resulting from this comparison and indicated by a threshold being exceeded is signalled by an abnormal consumption alarm, as well as by an indication of the estimated range.

12. Method as in claim 1, wherein the average consumption is used to estimate whether the range is sufficient to complete a flight in progress, with the generation, if it is not the case, of an insufficient range alarm, as well as an indication of an estimated range.

13. IT system for implementing the method for calculating the oil consumption and range associated with the lubrication system of an airplane engine during flights, the engine comprising turbine engine, as claim 1, characterised in that it comprises:

a memory (1) with a main program for implementing said process, as well as data relating to the flight in progress and to next flights, and data relating to at least the other engine of the airplane;

a first programmable data processor (2), called a short-term processor, operated under control of said main program for estimating the interference effects on the oil consumption, for estimating the total quantity of oil available, the current and average consumptions of the engine, for detecting consumption anomalies compared with one or several thresholds and for calculating the range for the flight in progress and for the next flights;

a second programmable data processor (3), called a middle-term processor, operated under the control of said main program, for calculating the current and average consumptions of the engine, from the total quantity of oil available, for each phase of the flight;

a third programmable data processor (4), called a long-term processor operated under the control of said main program and EFH, for evolvingly re-evaluating gulping-estimation parameters depending on data acquired during previous flights, for calculating the average consumption taking into account previous flights and which can be used to calculate the range of the next flights and for re-evaluating normal consumption thresholds;

a means for displaying alarms and visual and/or sound indications (5).

14. An IT system as in claim 13, wherein the alarms and indications comprise at least one refill indication in a certain number of future flights, which can be displayed upon landing, an insufficient range alarm with display of an range value, an abnormal consumption alarm with display of an range value, a low oil level alarm with display of an range value and an oil level reading fault alarm.

15. IT system as in claim 13, wherein said first, second and third processors are replaced by secondary sub-programmes that fulfil their functions and are stored in the memory with the main program.

16. A computer readable storage medium storing a computer-executable program usable to implement the process for calculating the oil consumption and range associated with the lubrication system of an airplane engine during flights, as in claim 13, when said program is executed on a computer.

17. Computer program as in claim 16, stored in a memory medium readable by a computer.

* * * * *

UNITED STATES PATENT AND TRADEMARK OFFICE

CERTIFICATE OF CORRECTION

PATENT NO. : 8,483,902 B2
APPLICATION NO. : 12/334981
DATED : July 9, 2013
INVENTOR(S) : Albert Cornet et al.

It is certified that error appears in the above-identified patent and that said Letters Patent is hereby corrected as shown below:

In the Claims

Col. 7, line 37 - Col. 8, line 22 should read

1. Method for calculating oil consumption and range associated with a lubrication system of an airplane engine during flights, the airplane including a plurality of engines, based on a measurement of an oil level in a tank of said lubrication system, allowing management of refills and maintenance and detection of either abnormal consumption or insufficiency range, characterised by a combination of the following methods:

comparing with a processor different engines of the airplane and possibly a reference value, the engines used for said comparison being in more or less identical condition, in order to detect abnormal oil consumption;

taking into account with a processor one or more interference effects that affect said oil level in the tank, these being linked at least to the thermal expansion in the tank, to gulping and to attitude and acceleration, in order to deduce a modification to the oil level due to a decrease in total quantity of oil available as a result of said interference effects; and wherein, for a measurement and detection when the airplane is landed or during flights:

oil levels are measured several times during each phase and during the transitories;

an average gulping is estimated depending on an oil temperature and on rotation speed, including in flight during transitories;

a range value is deduced from there and is specific to future flights; and characterised by the following sub-stages:

a current oil level is measured in the oil tank of one of the engines;

said interference effects are estimated, including gulping;

Signed and Sealed this
Third Day of September, 2013

Teresa Stanek Rea
*Acting Director of the United States Patent and Trademark Office* a value of the quantity of oil available is calculated by subtracting from the *a priori* known total quantity of oil a difference in oil quantity associated with a quantity retained outside the tank as a result of these interference effects, linked in particular to gulping;

if the value of the available quantity is lower than a predetermined threshold value, a low oil level alarm is emitted and a range value in hours is communicated;

based on the total quantity of oil, a current and an average oil consumption of the engine are calculated over the flight phase in progress or over a rolling period during the flight phase in progress, a length of which is fixed by a required accuracy;

the current consumption value is used in a comparison and range estimation unit whereas the average consumption value is recorded and processed in a processing unit called a long term processor in which thresholds of normal consumption resulting from measurements and calculations from previous flights are re-evaluated in particular in view of this average consumption value, of a total flight time of the engine and of a number of maintenance sessions performed.